US009625104B2

(12) United States Patent
Lee et al.

(10) Patent No.: US 9,625,104 B2
(45) Date of Patent: Apr. 18, 2017

(54) LED LIGHT AND METHOD OF MANUFACTURING THE SAME

(71) Applicant: LG ELECTRONICS INC., Seoul (KR)

(72) Inventors: Donghyun Lee, Seoul (KR); Jaepyo Hong, Seoul (KR); Seokjae Jung, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 0 days.

(21) Appl. No.: 14/280,111

(22) Filed: May 16, 2014

(65) Prior Publication Data

US 2015/0016115 A1 Jan. 15, 2015

(30) Foreign Application Priority Data

Jul. 10, 2013 (KR) ..... 10-2013-0081015

(51) Int. Cl.

| | |
|---|---|
| ***F21V 29/00*** | (2015.01) |
| ***F21K 99/00*** | (2016.01) |
| ***F21V 31/00*** | (2006.01) |
| ***F21V 19/00*** | (2006.01) |
| ***F21K 9/90*** | (2016.01) |
| ***F21V 29/507*** | (2015.01) |
| ***F21V 29/78*** | (2015.01) |

(Continued)

(52) U.S. Cl.

CPC ..... *F21K 9/10* (2013.01); *F21K 9/20* (2016.08); *F21K 9/90* (2013.01); *F21V 19/0055* (2013.01); *F21V 29/006* (2013.01); *F21V 29/30* (2013.01); *F21V 29/507* (2015.01); *F21V 29/78* (2015.01); *F21V 31/005* (2013.01); *F21Y 2101/00* (2013.01); *Y10T 29/49963* (2015.01)

(58) Field of Classification Search

CPC ..... F21V 29/006; F21V 29/70; F21K 9/135

See application file for complete search history.

(56) References Cited

U.S. PATENT DOCUMENTS 3,518,420 A * 6/1970 Kripp ..... F21S 8/02 248/343

8,177,397 B1 * 5/2012 Knoble et al. ..... 362/373

(Continued)

FOREIGN PATENT DOCUMENTS

WO WO 2011/055659 5/2011

WO WO 2013/049982 A1 4/2013

OTHER PUBLICATIONS

European Search Report issued in Application No. 14167724.5 dated May 8, 2015.

(Continued)

*Primary Examiner* — Evan Dzierzynski

(74) *Attorney, Agent, or Firm* — KED & Associates, LLP

(57) ABSTRACT

Provided is an LED light that includes a base plate, heat pipes disposed on the base plate, at least one heat dissipation fins disposed on the heat pipes, and an LED module fastened to the base plate by screws, in which protrusions having a space with the bottom open integrally protrude from the base plate and a thread for thread-fastening of the screw is formed around the inner side of the protrusions. Accordingly, water or foreign substances from cannot flow into the LED module through around the screw, with high waterproof ability.

19 Claims, 5 Drawing Sheets

(51) Int. Cl.
*F21K 9/20* (2016.01)
*F21Y 101/00* (2016.01)

(56) References Cited

U.S. PATENT DOCUMENTS

| | | | | |
|---|---|---|---|---|
| 8,405,947 | B1 * | 3/2013 | Green | H05B 33/0803 361/103 |
| 8,449,154 | B2 | 5/2013 | Uemoto et al. | |
| 2006/0056169 | A1 | 3/2006 | Lodhie et al. | |
| 2006/0267036 | A1 | 11/2006 | Lee et al. | |
| 2007/0230194 | A1 * | 10/2007 | Julia Vilarrasa | 362/373 |
| 2007/0285926 | A1 * | 12/2007 | Maxik | 362/294 |
| 2008/0043479 | A1 | 2/2008 | Wang | 362/373 |
| 2009/0151900 | A1 | 6/2009 | Huang | 165/80.3 |
| 2009/0230834 | A1 * | 9/2009 | Liu | 313/12 |
| 2009/0296411 | A1 | 12/2009 | Chang et al. | 362/373 |
| 2011/0000648 | A1 | 1/2011 | Chien | 165/104.26 |
| 2011/0063831 | A1 * | 3/2011 | Cook | 362/235 |
| 2011/0090669 | A1 | 4/2011 | Sun et al. | 362/84 |
| 2011/0210657 | A1 * | 9/2011 | Paik | 313/46 |
| 2012/0049716 | A1 * | 3/2012 | Chen et al. | 313/46 |
| 2012/0098401 | A1 | 4/2012 | Yu et al. | 313/46 |
| 2012/0162983 | A1 * | 6/2012 | Pickholz | 362/235 |
| 2012/0206927 | A1 | 8/2012 | Miyahara | 362/382 |
| 2012/0286641 | A1 * | 11/2012 | Tsai | 313/46 |
| 2013/0077293 | A1 | 3/2013 | Lee et al. | 362/184 |
| 2013/0294070 | A1 | 11/2013 | Tsao | |
| 2014/0177226 | A1 * | 6/2014 | Goelz et al. | 362/294 |

OTHER PUBLICATIONS

U.S. Notice of Allowance dated Oct. 20, 2016 issued in U.S. Appl. No. 14/298,118.

European Search Report issued in Application No. 14174110.8 dated Oct. 30, 2014.

U.S. Office Action issued in co-pending U.S. Appl. No. 14/298,118 dated Jul. 30, 2015.

* cited by examiner

LED LIGHT AND METHOD OF MANUFACTURING THE SAME

CROSS-REFERENCE TO RELATED APPLICATION(S)

This application claims priority under 35 U.S.C. §119 to Korean Application No. 10-2013-0081015 filed on Jul. 10, 2013, whose entire disclosure is hereby incorporated by reference.

BACKGROUND

1. Field

The present disclosure relates to an LED light and a method of manufacturing the same, particularly an LED light with a waterproofed base plate with an LED module fastened thereto.

2. Background

LED lights and methods of manufacturing the same are known. However, they suffer from various disadvantages.

BRIEF DESCRIPTION OF THE DRAWING

The embodiments will be described in detail with reference to the following drawings in which like reference numerals refer to like elements wherein.

DETAILED DESCRIPTION

Hereinafter, embodiments of an LED light according to the present disclosure are described with reference to the accompanying drawings. In general, LED lights are lights using LEDs (Light Emitting Diode) as the sources of light. The LED lights are being used increasingly more because of the long lifespan and high energy efficiency.

The LED lights may include an LED module and a base plate where the LED module is disposed. The LED module may be fastened to the base plate by fasteners. Fastener through-holes through which fasteners pass may be formed on the LED module and the base plate. The fasteners may be inserted through the fastener through-holes at one of the LED module or the base plate.

Figure 1:
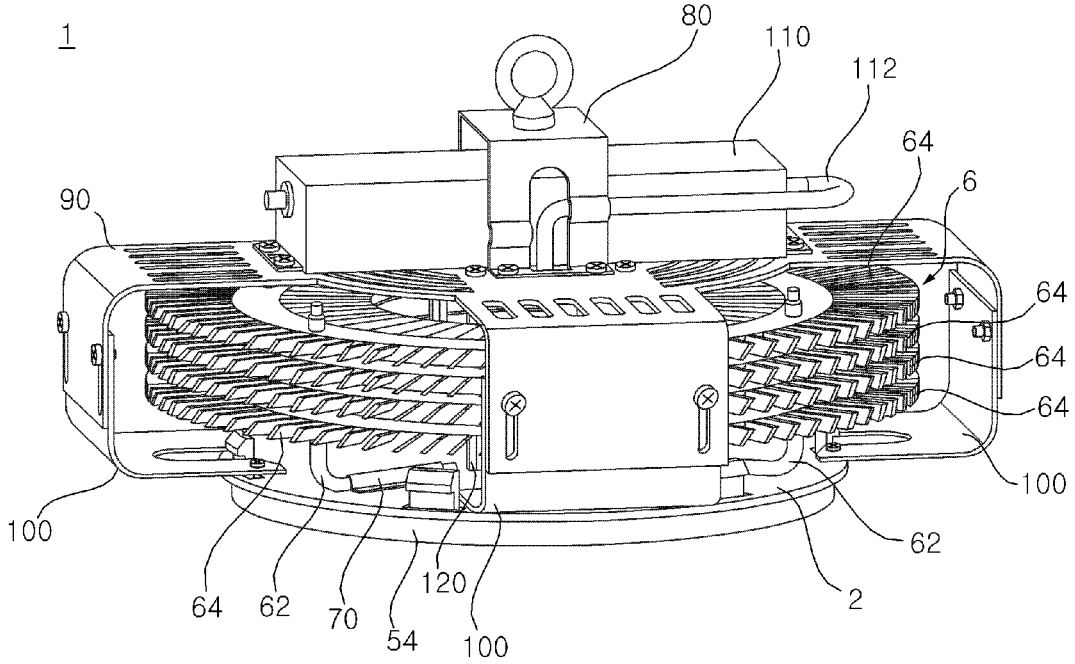
FIG. 1 is a perspective view showing an embodiment of an LED light according to the present disclosure.
Figure 2:
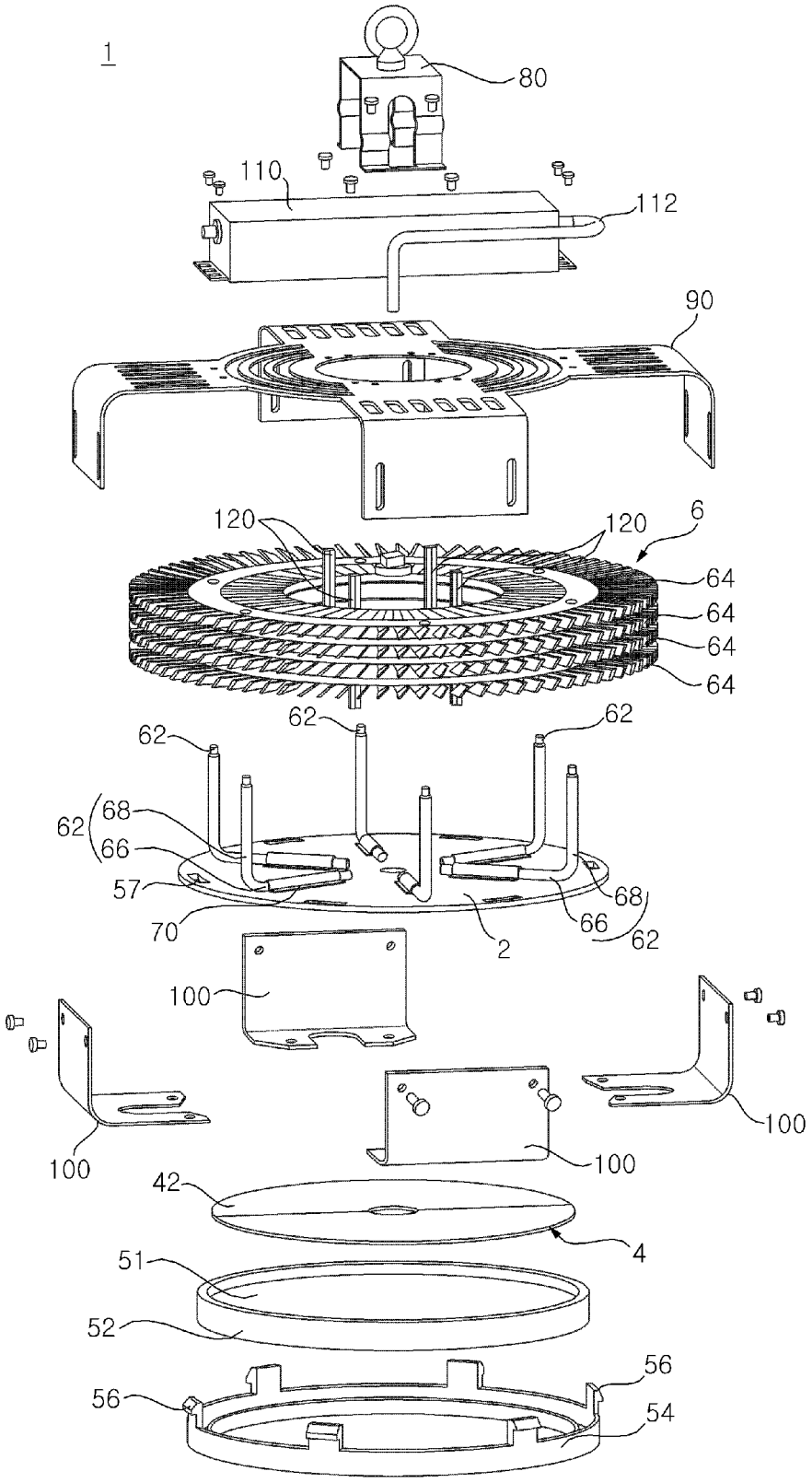
FIG. 2 is an exploded perspective view showing the embodiment of an LED light according to the present disclosure.
Figure 3:
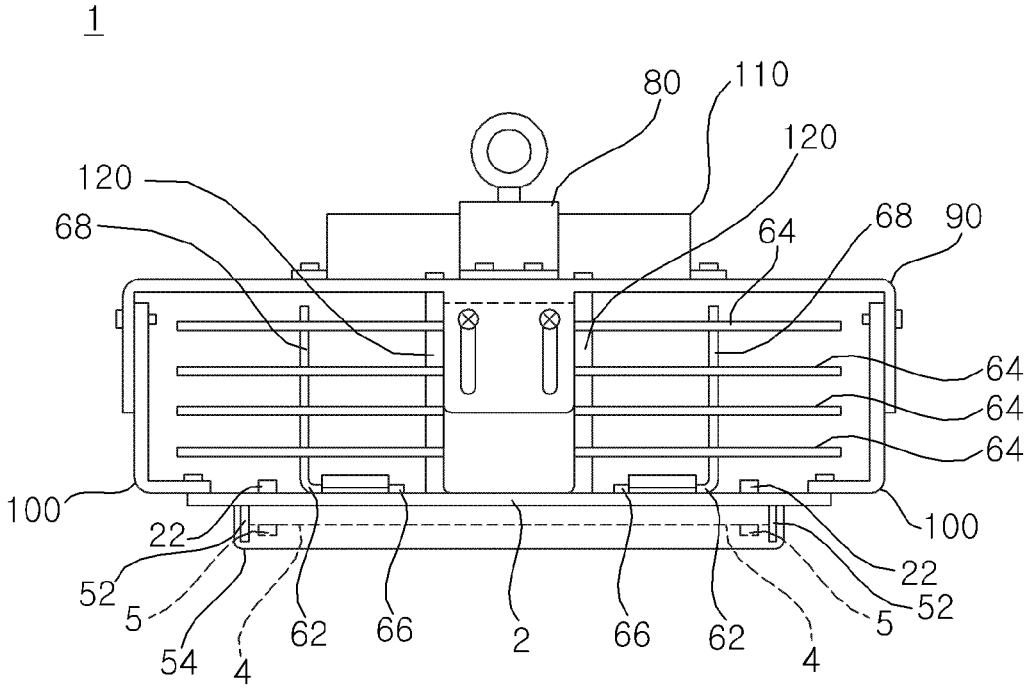
FIG. 3 is a side view showing an embodiment of an LED light according to the present disclosure.

FIG. 1 is a perspective view showing an LED light according to one embodiment of the present disclosure, FIG. 2 is an exploded perspective view of the LED light, and FIG. 3 is a sectional view of the LED light. An LED light may include a base plate 2 and an LED module 4 disposed beneath the base plate 2. In the LED light 1, the heat generated from the LED module 4 may transfer to the base plate 2 and the heat transferred to the base plate 2 may be transferred to the heat dissipation module 6 and dissipated through the heat dissipation module 6. The heat dissipation module 6 may be disposed on the base plate 2 and supported by the base plate 2.

The LED module 4 may be disposed on the base plate 2. The LED module 4 is disposed beneath the base plate 2. The LED module 4 may be disposed to be able to radiate light downward. The LED module 4 may be supported on the base plate 2 and the load of the LED module 4 may be applied to the base plate 2. The LED module 4 may include a metallic top plate 42, a PCB on the bottom of the top plate, and a plurality of LEDs arranged in a dot formation on the PCB. The top plate 42 of the LED module 4 can function as a heat dissipation plate that absorbs and transfers the heat from the PCB to the heat dissipation module 6. The top plate 42 of the LED module 4 may be formed in a plate shape.

The LED light may further include a light transmission window 51 and a gasket 52 that surrounds the light transmission window 51. The LED light 1 may further include a front cover 54 detachably attached to the base plate 2. The light transmission window 51 may be a lens that transmits the light radiated from LEDs. The light transmission window 51 may be fixed around the gasket 52.

The gasket 52 may be formed in a ring shape. The gasket 52 may be sized to surround the edge of the LED module 4 and may prevent water or foreign substances from flowing into the LED module 4. The gasket 52 may be seated and supported on the front cover 54.

The front cover 54 may include a lower plate with a light hole at the center, on which the gasket 52 is seated. The front cover 54 may have an edge or side surface that is bent from the lower plate and surrounding the gasket 52. The front cover 54 may be removably attached to the base plate 2. A hook 56 may be formed on the front cover 54 and a recess 57 (also notch or hole) corresponding to hook 56 where the hook 56 may be formed on the base plate.

The LED module 4 may be fastened to the base plate 2 by fasteners. The top plate of the LED module 4 may be fastened to the base plate 2 by fasteners. The fasteners that fasten the LED module 4 to the base plate may include a bolt or a screw with a threaded shank with a head. The fasteners in the present disclosure are assumed to be screws, but the present disclosure is not limited to screws and may include other types of fasteners. The base plate 2 and the LED module 4 may be fastened by screws and the combination of the base plate 2 and the LED module by fasteners is described below.

The LED module 4 may be disposed on the base plate 2. The load of the dissipation module 6 may be supported by the base plate 2. The heat dissipation module 6 can absorb the heat of the base plate 2 and dissipate it to the atmosphere. The heat dissipation module 6 may be a heat dissipation plate with at least one heat dissipation fins and may include heat pipes 62 receiving the heat of the base plate 2 and at least one heat dissipation fin 64 receiving heat from the heat pipes 62 and dissipating it to the atmosphere. It is assumed in the following description that the heat dissipation module 6 includes the heat pipes 62 and at least one heat dissipation fins 64. The heat pipes 62 may be disposed at the base plate 2 and the heat dissipation fins 64 may be disposed at the heat pipes 62.

The heat pipes 62 may have a heat absorbing portion 66 that is in contact with the base plate 2 and a heat dissipating portion 68 that is in contact with the heat dissipation fins 64. The heat absorbing portion 66 and the heat dissipating portion 68 may be integrally formed. The heat dissipating portion 68 may bend from the heat absorbing portion 66. The heat dissipating portion 68 may be perpendicular to the heat absorbing portion 66. The heat absorbing portion 66 may be horizontally disposed on the base plate 2 and the heat dissipating portion 68 may be vertically disposed over the base plate 2.

The heat pipe 62 may have a space in which a working fluid flows. The working fluid may rise to the heat dissipating portion 68 by vaporizing in the heat absorbing portion 66 and may descend to the heat absorbing portion 66 by cooling in the heat dissipating portion 68. The heat pipe 62 may be rounded at the joint of the heat absorbing portion 66 and the heat dissipating portion 68. The heat dissipation module 6 may include a plurality of heat pipes 62. The heat pipes 62 may be spaced from each other. The heat pipes 62 may be spaced horizontally over the base plate 2. The heat pipes 62 may be fixed with the heat dissipation fins 64. The heat dissipation fins 64 may be fixed with the heat dissipating portions 68 of the heat pipes 62.

In the heat absorbing portion 66 and the heat dissipating portion 68 of the heat pipe 62, the heat absorbing portion 66 may be fixed to the base plate 2. The heat absorbing portion 66 can be installed on the base plate 2 by an adhesive material such as an adhesive and can be installed on the base plate 2 by a heat pipe holder 70.

The heat pipe holder 70 may cover at least a portion of the heat absorbing portion 66 and the heat pipe 62 may be fixed with at least a portion of the heat absorbing portion 66 between the base plate 2 and the heat pipe holder 70. The heat pipe holder 70 may surround a portion of the heat absorbing portion 66 of the heat pipe holder 70. The heat pipe holder 70 may be fastened to the base plate by fasteners. The heat pipe holder 70 may be fastened to a fastening portion that protrudes from the base plate 2. The fastening portion may be formed integrally on the base plate 2. In certain embodiments, the heat pipe holder 70 may be a clamp.

The heat dissipation fin 64 may be disposed on the heat pipe 62. The heat dissipation fin 64 may be disposed on the heat dissipating portion 68 of the heat pipe 62. The heat dissipation fins 64 may be disposed and supported on a plurality of heat pipes 62. The heat dissipation module 6 may include a plurality of heat dissipation fins 64. The heat dissipation fins 64 may be arranged on the heat dissipating portions 68. The heat dissipation fins 64 may be spaced from each other on the heat dissipating portions 68. The heat dissipation fins 64 may be spaced vertically from each other on the heat dissipating portions 68. In the heat dissipation module 6, the heat dissipation fins 64 may be spaced vertically from each other on the heat pipes 62 horizontally spaced from each other. The heat dissipation fins 64 may be fitted on the heat dissipating portions 68. A heat pipe-fixing hole may be formed at the heat dissipation fins 64. A plurality of heat pipe-fixing holes may be formed at each of the heat dissipation fins 64 and the number may be the same as the number of the heat pipes 62 on the base plate 2. In the heat pipe 62, the heat dissipating portions 68 may be combined with the heat dissipation fins 63 by being sequentially fitted in the heat pipe-fixing holes at the heat dissipation fins 64.

The LED light may further include a hanger 80 for mounting the LED light on the ceiling or a wall in a room. The hanger 80 may be fastened to at least one of the base plate 2, the heat dissipation module 6, or an upper bracket 90, which is described below, and can support the load of the LED light.

The LED light may include the upper bracket 90. The LED light may include lower brackets 100 fastened to the base plate 2 and the upper bracket 90. At least one of the upper bracket 90 and the lower bracket 100 may be disposed to surround a portion of the edge of the heat dissipation module 6. At least one of the upper bracket 90 and the lower bracket 100 may function as a handle that allows a person who installs or services the light to hold the LED light.

At least one of the upper bracket 90 and the lower bracket 100 may function as a heat dissipation module housing that protects of the heat dissipation module 6. The upper bracket 90 may be fastened to the hanger 8. The lower bracket 100 may be fastened to the base plate 2 by fasteners and to the upper bracket 90 with the height adjustable.

The LED light may further include the converter 110 that is a rectifier converting AC into DC. The converter 110 may be connected with the LED module 4 by a wire 112. The converter 110 can apply DC to the LED module 4 through the wire 112. The converter 110 may be mounted on the upper bracket 90.

The LED light may further include studs 120 connecting the base plate 2 and the upper bracket 90. The studs 120 may be formed in a hollow cylindrical shape. The stud 120 can function as a support that supports the base plate 2 to the upper bracket 90. The load of the heat dissipation module 6 and the load of the LED module 4 may be applied to the base plate 2 and the studs 120 can support the base plate 2 to the upper bracket 90 together with the heat dissipation module 6 and the LED module 4.

Figure 4:
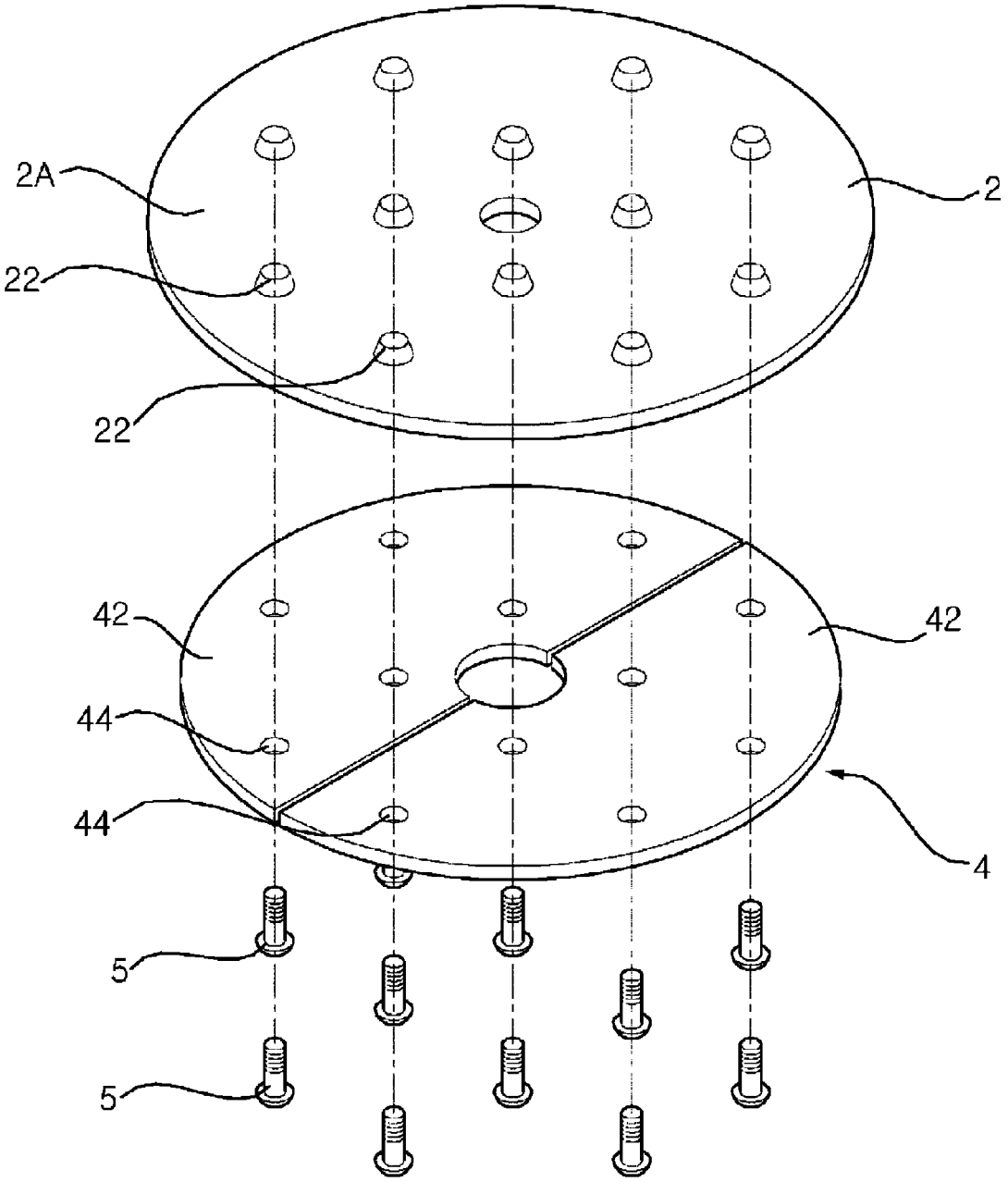
FIG. 4 is an exploded perspective view showing a fastening structure of a base plate and an LED module of an embodiment of an LED light according to the present disclosure.
Figure 5:
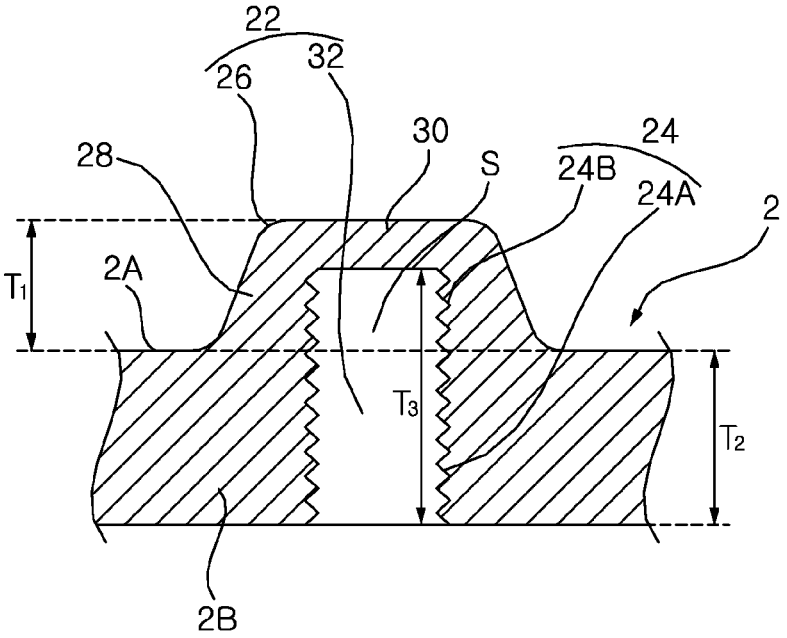
FIG. 5 is an enlarged cross-sectional view of the fastening structure shown in FIG. 4.
Figure 6:
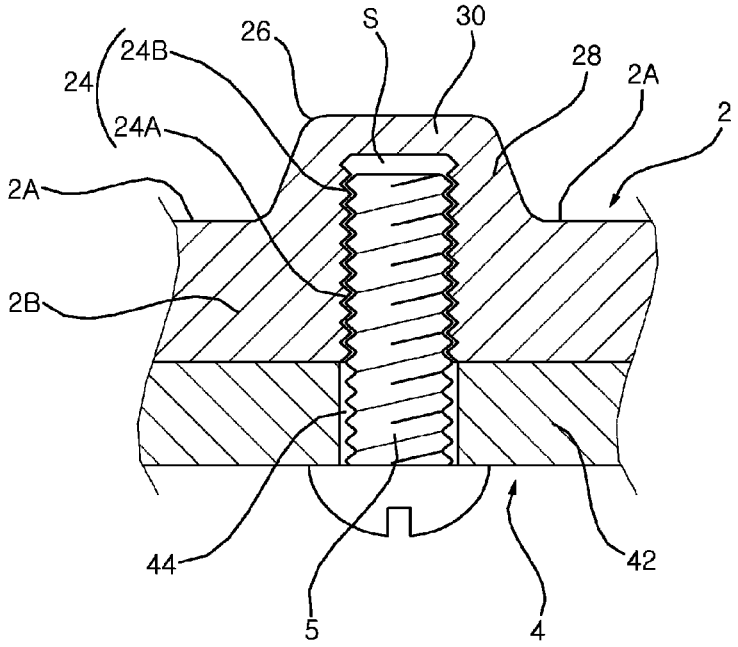
FIG. 6 is a cross-sectional view showing main parts when the LED module shown in FIG. 4 is fastened to a base plate by a fastener.

FIG. 4 is an exploded perspective view showing a fastening structure of a base plate and an LED module of an embodiment of an LED light according to the present disclosure, FIG. 5 is an enlarged cross-sectional view of the fastening structure of FIG. 4, and FIG. 6 is a cross-sectional view of the LED module of FIG. 4 fastened to the base plate of FIG. 5.

The LED module 4 may be fastened to the base plate 2 by screws 5. Fastening portions 22 where the screws 5 are inserted may be formed on the base plate 2. In the LED module 4, screw through-holes 44 through which the screws 5 are inserted my be formed and the screws 5 may be inserted in the fastening portions 22 through which the screw through-holes 44 of the LED module 4. The numbers of the screw through-holes 44 and the fastening portions 22 of the LED module 4 may be the same as the number of the screws 5.

The fastening portion 22 may function as a waterproof fastening portion where the screw 5 is inserted while preventing water or foreign substances on the top 2A of the base plate 2 from flowing to the screw 5. That is, the base plate 2 does not have screw holes extending through the top surface of the base plate 2. Water or foreign substances on the top 2A of the base plate 2 is blocked by the fastening portion 22, such that they cannot flow into the fastening portion 22. The fastening portion 22 may be a burring tap portion and a non-through burring tap portion through which the screw 22 cannot fully pass. The fastening portion 22 may be integrally formed on the base plate 2 such that a gap through which water between the base plate 2 and the fastening portion 22 can flow inside is not formed.

The fastening portion 22 may have a thread 24 for thread-fastening of the screw 5. The fastening portion 22 may be formed to surround the screw 5 thread-fastened to the thread 24. At least a portion of the fastening portion 22 may protrude from the base plate 2. The fastening portion 22 may protrude opposite to the LED module 4. The fastening portion 22 may be spaced from the heat dissipation module 6. The fastening portion 22 may be spaced from the heat pipe 62 and the heat dissipation fin 64.

The fastening portion 22 may have a protrusion 26 formed on the base plate 2. The protrusion 26 may integrally protrude from the base plate 2. The protrusion 26 may have a space S with the bottom open. The space S may be formed in the protrusion 26. The space S may be formed in the protrusion 26, communicating with a screw through-holes 32 that is described below. The protrusion 26 may surround a portion of the screw 5. The protrusion 26 may protrude opposite to the LED module 4. The protrusion 26 may protrude with a step $T_1$ from the top 2A of the base plate 2. The space S may have the top and the side closed and the bottom open. The protrusion 26 may have a thread 24 around the inner side for thread-fastening of the screw 5. The protrusion 26 may have a hollow cylinder 28 protruding from the base plate 2 and a top plate 30 closing the top of the hollow cylinder 28. The thread 24 may be formed around the inner side of the hollow cylinder 28. The top plate 30 may be a circular plate.

The fastening portion 22 may further have the screw through-hole 32 formed on the base plate 2. The screw through-hole 32 may communicate with the space S. The screw through-hole 32 may be formed under the space S. The screw through-hole 32 and the space S may form a screw space (also referred to herein as a screw hole) that receives a portion of the screw 5 inserted. The screw through-hole 32 may be positioned between the space S and the LED module 4. The space S may be disposed over the screw through-hole 32. The base plate 2 may have the protrusion 26 and a plate portion 2B divided by the portion where the protrusion 26 protrudes on the base plate 2. The screw through-hole 32 may be formed at the plate portion 2B, and the protrusion 26 may cover the screw through-hole 32, outside the screw through-hole 32.

The plate portion 2B may be the portion except the protrusion 26 of the bate plate 2 and may be a non-protruding portion. The plate portion 2B may have a thickness $T_2$. The protrusion 26 may protrude from the top 2A of the plate portion 2B, with a step having a height $T_1$ from the top of the plate portion 2B. The screw through-hole 32 may have a thread 24 for thread-fastening of the screw 5. The screw through-hole 32 may be formed and the thread 24 may be formed in the screw through-hole 32, in the plate portion 2B. Moreover, the screw space or screw hole (e.g., the combination of space S and through-hole 32) may have a depth $T_3$ that includes both the depths of the screw through-hole 32 and the space S. Here, the screw hole may extend a distance $T_3$, to extend past the thickness $T_2$ of the base plate 2 but below the top surface 30.

The thread 24 may be formed only around the inner side of the protrusion 26, not on the screw through-hole 32, in which the screw 4 can be thread-fastened to the protrusion 26. Alternatively, the thread 24 may be formed on the screw through-hole 32, not around the inner side of the protrusion 26, in which the screw 4 can be thread-fastened to the screw through-hole 32, not the protrusion 26.

The thread 24 may be formed around the inner side of the protrusion 26 and on the screw through-hole 32, in which the screw 4 can be thread-fastened to the protrusion 26 and the screw through-hole 32. The thread 24 may be continuously formed on the screw through-hole 32 and around the inner side of the protrusion 26. When the thread 24 is continuously formed on the screw through-hole 32 and around the inner side of the protrusion 26, the fastening force with the screw 4 can be increased. When the screw 4 is tightened, the screw 4 can be thread-fastened to the thread on the screw through-hole 32 and a portion of it can be inserted in the spaces and thread-fastened to the thread on the protrusion 26. The thread 24 may have a first screw 24A formed on the screw through-hole 32 and a second thread 24B formed around the inner side of the protrusion 26. The second thread 24B may be formed spirally continuously from the first thread 24A. The second thread 24B may be shorter than the first thread 24A.

On the other hand, the method of manufacturing an LED light may include a pressing step that forms the protrusion 26 while forming the screw through-hole 32 by pressing a portion of the base plate 2 with a press. The method of manufacturing an LED light may include a burring tap step that forms the thread 24 on at least one of the screw through-hole 32 and the inner side of the protrusion 26 while burring the inside of the screw through-hole 32 and the protrusion 26. The method of manufacturing an LED light may include a thread-fastening step that tightens the screw 5 to the screw through-hole 44 and the thread 24 of the LED module 4, with the screw through-hole 32 of the base plate 2 aligned with the screw through-hole 44 of the LED module.

In the LED light, when the base plate 2 and the LED module 4 are fastened by screws, the fastening portion 22 can surround the portion where the screw 5 passes through the screw through-hole 32 of the base plate. The fastening portion 22 may be formed on the base plate 2 such that there is no gap through which water or foreign substances flow inside between the screw through-hole 32 and the fastening portion 22 of the base plate 2. That is water or foreign substances on the top 2A of the base plate 2 cannot flow into the LED module 4 through the screw through-hole 32 of the base plate. Accordingly, the waterproof ability of the LED light can be improved.

As can be appreciated in the foregoing disclosure of an LED light as broadly described and embodied herein, one object of the present disclosure is to provide an LED light with high waterproof ability. Another object of the present disclosure is to provide a method of manufacturing an LED light that can make a base plate waterproof in a simple process.

In one embodiment, an LED light according to the present disclosure may include a base plate having a first surface and a second opposite the first surface, at least one heat pipe provided over the base plate and thermally coupled to the first surface of the base plate, a plurality of heat dissipation fins thermally coupled to the at least one heat pipe, and an LED module coupled to the second surface of the base plate by screws. The base plate may include a plurality of screw holes formed through the second surface and a plurality of protrusions that protrudes from the first surface corresponding to the plurality of holes. Moreover, the base plate may have a prescribed thickness between the first and second surfaces and the screw holes have a prescribed height, the prescribed height of the screw holes being greater than the thickness of the base plate and less than a prescribed height of the protrusions from the second surface.

The hole may be enclosed at a distal end toward the first surface and opened at a distal end toward the second surface. The protrusions may include a lateral surface that protrudes from the first surface of the base plate and a top surface provided over the lateral surface.

The holes may extend past the second surface of the base plate and may extend a prescribed amount into a corresponding protrusion. The holes may be encased by the corresponding protrusion. The protrusions may be formed integrally to the base plate. Moreover, the holes may include threads for the screws, the threads being formed around a surface of the hole that corresponds to at least one of the protrusion or the base plate.

The LED light may further include a lower cover provided below the LED module to cover the LED module. A gasket may be provided around the LED module between the base plate and the lower cover and configured to provide a watertight seal for the LED module.

In one embodiment, an LED light may include a base plate, at least one heat pipe provided over the base plate and thermally coupled to an upper surface of the base plate, a plurality of heat dissipation fins thermally coupled to the at least one heat pipe, an LED module coupled to a lower surface of the base plate, a lower cover provided below the LED module to cover the LED module, and a gasket provided around the LED module between the base plate and the lower cover and configured to provide a watertight seal for the LED module. The base plate may include a plurality of screw holes formed through the lower surface, the plurality of screw holes having a prescribed length greater than a thickness of the base plate to protrude over the upper surface of the base plate.

The base plate may include a plurality of protrusions formed on the upper surface that correspond to each of the screw holes. The screw holes may extend a prescribed amount past the upper surface into the corresponding protrusion. The screw holes may be formed to not extend beyond the corresponding protrusion. Moreover, a distal end of each screw hole extending past the upper surface may be enclosed by the corresponding protrusion.

The plurality of protrusions may include a lateral surface that inclines from the upper surface of the base plate and a top surface adjacent to the lateral surface, the lateral surface and top surface of the protrusion encasing the portion of the screw hole that extends past the upper surface of the base plate. The plurality of protrusions may be formed integral to the base plate.

The screw holes may include threads for screws that couple the LED module to the base plate. The threads may only be formed on either the portion of the screw hole that extends past the upper surface or on a portion of the screw hole between the upper and lower surfaces of the base plate.

In one embodiment, a method of manufacturing an LED light may include forming a plurality of holes in a base plate by pressing a lower side of the base plate with a press, the holes extending beyond an upper side of the base plate to form protrusions on the upper side of the base plate, forming threads around an inner surface of the holes corresponding to at least one of the base plate or the protrusions, forming holes in an LED module to correspond to the holes in the base plate, and fastening the LED module to the lower side of the base plate by threading screws through corresponding holes in the LED module and the base plate, wherein the plurality of holes in the base plate do not extend through the base plate and the protrusions.

The method may further include coupling a plurality of heat conducting pipes on the upper side of the base plate, coupling a heat sink to the plurality of heat conducting pipes over the base plate, and coupling an enclosure below the lower side of the base plate for the LED module. The enclosure may be sealed using a gasket to provide a watertight seal for the LED module.

In one embodiment, an LED light may include a base plate, heat pipes disposed on the base plate, at least one heat dissipation fins disposed on the heat pipes, and an LED module fastened to the base plate by screws, in which protrusions having a space with the bottom open integrally protrude from the base plate and a thread for thread-fastening of the screw is formed around the inner side of the protrusions.

The space may have the top and the side closed and the bottom open. The protrusion may protrude with a step from the top of the base plate. The protrusion may have a hollow cylinder protruding from the base plate and a top plate covering the top of the hollow cylinder. Moreover, the protrusion may protrude opposite to the LED module.

In one embodiment, an LED light may include a base plate, heat pipes disposed on the base plate, at least heat dissipation fins disposed on the heat pipes, and an LD module fastened to the base plate by screws, in which screw through-holes with a thread where the screws are thread-fastened are formed at the base plate, spaces that communicate with the screw through-holes are formed in the base plate, and protrusions partially surrounding the screws are integrally formed with the base plate. Here, the protrusion may protrude opposite to the LED module.

In one embodiment, an LED light may include a base plate, a heat dissipation module disposed on the base plate, and an LED module fastened to the base plate by screws, in which threads for thread-fastening the screws and fastening portions surrounding the screws thread-fastened to the threads are formed at the base plate, and the fastening portions at least partially protrude.

The fastening portion may protrude opposite to the LED module. The fastening portion may be spaced from the heat dissipation module. The fastening portion may have a protrusion protruding from the base plate and having a space with the bottom open, and a screw through-hole formed at the base plate to communicate with the space.

The thread may be formed around the inner side of at least one of the protrusion and the screw through-hole. The thread may be continuously formed around the inner side of the screw through-hole and the protrusion.

In one embodiment, a method of manufacturing an LED light according to the present disclosure may include forming protrusions while forming screw through-holes by pressing a portion of a base plate with a press, forming a thread around the inner side of at least one of the screw through-holes and the protrusions while burring the inside of the screw through-holes and the protrusions, and thread-fastening screws to the screw through-holes of the LED module and the thread.

The LED light as broadly described and embodied herein has the advantage in that it is possible to prevent water or foreign substances from flowing into the LED module through around the screw, thereby enabling improved waterproofing. The LED light may also have the advantage in that it is possible to minimize the number of parts because the base plate itself surrounds the screws. Moreover, the disclosed LED light has the advantage in that a worker can easily recognize the assembly direction of the base plate by the protrusions on the base plate and incorrect assembly of the base plate can be prevented.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. An LED light comprising:

a base plate having an upper surface and a lower surface opposite the upper surface;

at least one heat pipe provided over the base plate and having a first portion thermally coupled to the upper surface of the base plate and a second portion that extends from the first portion;

an LED module coupled to the lower surface of the base plate by screws;

a plurality of heat dissipation fins provided over the base plate, the plurality of heat dissipation fins being spaced apart from each other and thermally coupled to the second portion of the heat pipes to dissipate heat from the LED module;

an upper bracket provided over the plurality of heat dissipation fins and fastened to a hanger;

a plurality of lower brackets coupled to the base plate and the upper bracket, wherein the base plate includes a plurality of screw holes formed through the lower surface and a plurality of protrusions corresponding to each of the plurality of screw holes that protrudes from the upper surface, wherein the base plate has a prescribed thickness between the upper and lower surfaces and the screw holes have a prescribed height, the prescribed height of the screw holes being greater than the thickness of the base plate and less than a prescribed height of the protrusions from the lower surface, wherein the upper bracket and the plurality of lower brackets are disposed to surround the plurality of heat dissipation fins on at least four sides of the plurality of heat dissipation fins and provided at a prescribed distance from lateral sides of the plurality of heat dissipation fins, wherein the upper bracket has a top plate and a plurality of side plates that bends downward from the top plate toward the plurality of lower brackets, the plurality of lower brackets have a bottom plate and a side plate that bends upward from the bottom plate toward the upper bracket, the plurality of heat dissipation fins are disposed between the top plate of the upper bracket and the bottom plate of the plurality of lower brackets, the plurality of heat dissipation fins are disposed between the plurality of side plates of the upper bracket, and the bottom plate of the plurality of lower brackets is fastened to an upper surface of the base plate.

2. The LED light of claim 1, wherein the hole is enclosed at a distal end toward the upper surface and opened at a distal end toward the lower surface.

3. The LED light of claim 1, wherein the protrusions include a lateral surface that protrudes from the upper surface of the base plate and a top surface provided over the lateral surface.

4. The LED light of claim 1, wherein the holes extend past the lower surface of the base plate and extend a prescribed amount into a corresponding protrusion.

5. The LED light of claim 4, wherein the holes are encased by the corresponding protrusion.

6. The LED light of claim 5, where the protrusions are formed integrally to the base plate.

7. The LED light of claim 5, wherein the holes include threads for the screws, the threads being formed around a surface of the hole that corresponds to at least one of the protrusion or the base plate.

8. The LED light of claim 7, further including a lower cover provided below the LED module to cover the LED module.

9. The LED light of claim 8, further including a gasket provided around the LED module between the base plate and the lower cover and configured to provide a watertight seal for the LED module.

10. The LED light of claim 1, wherein the plurality of heat dissipation fins are configured to have a disc shape that extends laterally between the side plates of the upper bracket and the plurality of lower brackets, and stacked vertically at prescribed intervals relative to each other.

11. An LED light comprising:

a base plate;

at least one heat pipe provided over the base plate and thermally having a first portion thermally coupled to an upper surface of the base plate and a second portion that extends from the first portion;

an LED module coupled to a lower surface of the base plate;

a plurality of heat dissipation fins provided over the base plate, the plurality of heat dissipation fins being spaced apart from each other and thermally coupled to the second portion of the heat pipes to dissipate heat from the LED module;

a lower cover provided below the LED module to cover the LED module; and a gasket provided around the LED module between the base plate and the lower cover and configured to provide a watertight seal for the LED module;

an upper bracket provided over the plurality of heat dissipation fins and fastened to a hanger; and a plurality of lower brackets coupled to the base plate and the upper bracket, a height between the lower, wherein the base plate includes a plurality of screw holes formed through the lower surface, the plurality of screw holes having a prescribed length greater than a thickness of the base plate to protrude over the upper surface of the base plate, wherein the upper bracket and the plurality of lower brackets are disposed to surround the plurality of heat dissipation fins on at least four sides of the plurality of heat dissipation fins and provided at a prescribed distance from lateral sides of the plurality of heat dissipation fins, wherein the upper bracket has a top plate and a plurality of side plates that bends downward from the top plate toward the plurality of lower brackets, the plurality of lower brackets have a bottom plate and a side plate that bends upward from the bottom plate toward the upper bracket, the plurality of heat dissipation fins are disposed between the top plate of the upper bracket and the bottom plate of the plurality of lower brackets, the plurality of heat dissipation fins are disposed between the plurality of side plates of the upper bracket, and the bottom plate of the plurality of lower brackets is fastened to an upper surface of the base plate.

12. The LED light of claim 11, wherein the base plate includes a plurality of protrusions formed on the upper surface that correspond to each of the screw holes.

13. The LED light of claim 12, wherein the screw holes extend a prescribed amount past the upper surface into the corresponding protrusion.

14. The LED light of claim 13, wherein the screw holes do not extend beyond the corresponding protrusion.

15. The LED light of claim 13, wherein a distal end of each screw hole extending past the upper surface is enclosed by the corresponding protrusion.

16. The LED light of claim 13, wherein the plurality of protrusions include a lateral surface that inclines from the upper surface of the base plate and a top surface adjacent to the lateral surface, the lateral surface and top surface of the protrusion encasing the portion of the screw hole that extends past the upper surface of the base plate.

17. The LED light of claim 16, wherein the plurality of protrusions are formed integral to the base plate.

18. The LED light of claim 13, wherein the screw holes include threads for screws that couple the LED module to the base plate.

19. The LED light of claim 11, wherein the plurality of heat dissipation fins are configured to have a disc shape that extends laterally between the side plates of the upper bracket and the plurality of lower brackets, and stacked vertically at prescribed intervals relative to each other.

* * * * *